US007137909B2

(12) United States Patent
Ohle

(10) Patent No.: US 7,137,909 B2
(45) Date of Patent: Nov. 21, 2006

(54) SOCCER KICKING TRAINING APPARATUS

(76) Inventor: Robert D. Ohle, 537 S. Flower St., Lakewood, CO (US) 80226

( * ) Notice: Subject to any disclaimer, the term of this patent is extended or adjusted under 35 U.S.C. 154(b) by 0 days.

(21) Appl. No.: 11/406,221

(22) Filed: Apr. 17, 2006

(65) Prior Publication Data

US 2006/0183572 A1 Aug. 17, 2006

Related U.S. Application Data

(63) Continuation of application No. 10/863,793, filed on Jun. 8, 2004, now Pat. No. 7,056,236.

(51) Int. Cl.
*A63B 69/00* (2006.01)

(52) U.S. Cl. ..... 473/423; 473/422

(58) Field of Classification Search ..... 473/422, 473/423, 427, 429, 438, 439, 446, 476–479
See application file for complete search history.

(56) References Cited

U.S. PATENT DOCUMENTS 2,328,744 A 9/1943 Roters
4,307,888 A 12/1981 Ohle
4,477,083 A 10/1984 Sowards
4,516,769 A 5/1985 Kopp
4,561,661 A 12/1985 Walker et al.
4,576,379 A 3/1986 Juhasz
4,616,834 A 10/1986 Davis
4,720,095 A 1/1988 Sowards
5,037,113 A 8/1991 Sowards
5,435,572 A 7/1995 Covel
5,494,278 A 2/1996 Linden
5,618,039 A 4/1997 Tsai et al.
5,951,414 A 9/1999 Sowards
6,475,108 B1 11/2002 Sarenana, Sr. et al.

*Primary Examiner*—Mitra Aryanpour
(74) *Attorney, Agent, or Firm*—Dorr, Carson & Birney, P.C.

(57) ABSTRACT

A soccer kicking practice apparatus is provided with an elongated soccer ball mounting arm comprised of a center shaft in the form of a roller chain positioned inside of a coil spring and a coil spring compression decompression device. An outside end of the elongated soccer ball mounting arm is provided with a soccer ball mounting device. An inside end of the soccer ball mounting arm is provided with a connector that serves to hold the mounting arm at a desired elevation. The center shaft and coil spring create a biasing system that returns the soccer ball to its original position after it has been kicked.

1 Claim, 9 Drawing Sheets

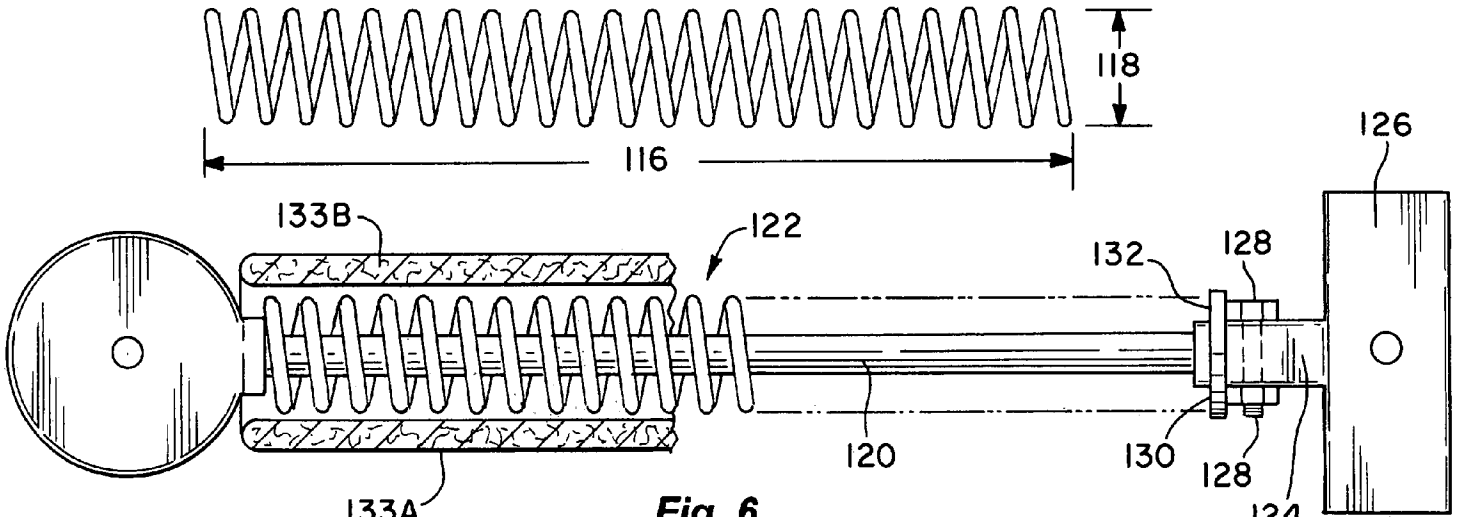
Fig. 5
Fig. 6
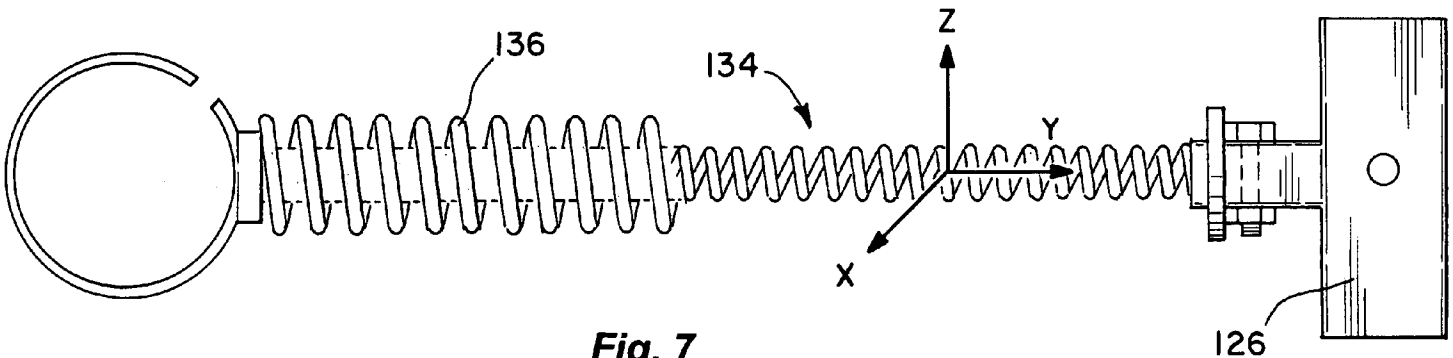
Fig. 7

SOCCER KICKING TRAINING APPARATUS

RELATED APPLICATIONS

This application is a continuation of U.S. patent application Ser. No. 10/863,793 filed Jun. 8, 2004 now U.S. Pat. No. 7,056,236 B2 entitled "Soccer Kicking Training Apparatus."

BACKGROUND OF THE INVENTION

1. Field of the Invention

The present invention generally relates to soccer ball kicking practice devices. It is particularly concerned with returning a kicked soccer ball to a desired kicking position without the necessity of retrieving and/or repositioning the kicked ball.

2. Discussion of the Background

Soccer ball kicking practice devices are well known. For example, U.S. Pat. No. 4,307,888 ("the '888 patent") teaches a soccer kicking trainer device having an elongated arm with an open loop at one end for seating and holding a soccer ball. The ball is attached to the loop by elastic bands. The other end of the elongated arm has an elbow which leads into an arm portion that extends vertically downward. The portion of the arm extending downward from the elbow is inserted loosely (and hence pivotally) in at least two holding eyes which are attached to a vertical mounting post. The '888 patent also teaches use of a biasing element (e.g., a block of hard rubber) for returning the kicked ball to its original position after it has been kicked.

The soccer kicking trainer device of the '888 patent does, however, have certain drawbacks. The main drawback is the fact that a kicked soccer ball attached to this device does not always return to its original kicking position. Indeed, it rarely does. That is to say that such a kicked ball will remain at the same elevation, but it will often come to rest in a new kicking position located somewhere on a semicircle defined by the radius of its elongated arm and the surface upon which the kicked ball impacts. In other words, the ball comes to rest according to several variable factors such as the force and angle of the preceding kick of the ball. Thus, the user often has to further position the ball in a desired location by hand or by foot.

SUMMARY OF THE INVENTION

A soccer ball kicking practice apparatus returns a kicked soccer ball (that is attached to said apparatus) to a desired kicking position. This return of the kicked soccer ball is particularly characterized by its speed and ball placement precision. These attributes are accomplished largely by virtue of the apparatus being provided with an elongated soccer ball mounting arm that has a flexible center shaft that is substantially surrounded by an elongated coil spring. The flexibility of the center shaft can be achieved in several different ways. For example, in one embodiment of this invention, the center shaft that is made in the form of a roller chain such as those hereinafter more fully described. When mounted according to the teachings of this patent disclosure, such a roller chain center shaft is flexible in a substantially horizontal plane, but is not flexible in a substantially vertical plane. Thus, a soccer ball mounted to a soccer kicking practice apparatus employing a roller chain as its center shaft can be easily kicked in a generally horizontal plane, but can not be easily kicked in a generally vertical plane since a roller chain mounted in the manner hereinafter described will not readily bend in a vertical direction.

In another embodiment of this invention, the center shaft is flexible by virtue of being made of an elastic material such as hard rubber, reinforced hard rubber, or an elastic polymeric material. In yet another embodiment of this invention, the center shaft can be made flexible by virtue of its being made in the form of a coil spring. Such a coil spring can be made of steel or an elastic polymeric material. It might also be noted here that when the center shaft is made of an elastic material such as hard rubber or an elastic polymeric material, or when the center shaft is in the form of a coil spring, a ball attached to such a center shaft can be kicked in virtually any direction.

Next it should be understood that whether the center shaft is in the form of a roller chain, a shaft or rod made of an elastic material or a coil spring, said center shaft will be substantially surrounded by a coil spring. In certain embodiments of this invention this coil spring is further provided with a spring compression/decompression device. That is to say that this coil spring can be placed in a given state of compression supplied by fixed abutment surfaces, or it can be placed between abutting surfaces wherein at least one of said abutting surfaces can be moved and thereby compress/decompress the coil spring. In either case, however, applicant has found that the flexible center shaft and surrounding coil spring construction serves to bring a kicked ball back to a desired position in a desirably short period of time.

All such elongated soccer ball mounting arms also will have a soccer ball mounting end and a connector end. The soccer ball mounting end will be provided with a soccer ball mounting device. For example, this soccer ball mounting device may be in the form of a plate having a hole for receiving a bolt that is attached to a modified soccer ball in a manner hereinafter more fully described. In the alternative, a regulation soccer ball (i.e., a soccer ball that is not modified by further providing it with a mounting bolt) may be attached to a soccer ball mounting device by use of one or more elastic straps such as those depicted in FIG. 5 of the '888 patent (to this end, the entire teachings of said '888 patent are hereby incorporated into the present patent disclosure). A soccer ball mounting net also may be employed for mounting a regulation soccer ball.

The opposite or connector end of any given center shaft of this patent disclosure also is provided with a connector device. Generally speaking, such a connector device will serve to connect the elongated soccer ball mounting arm to a holding post or to a construction element. Various different kinds of connector devices will be illustrated in subsequent parts of this patent disclosure. These connector devices may directly attach to a mounting surface such as a wall, a post, a tree, etc. In the alternative applicant's connector devices may further employ other mounting devices such as holding posts that are hereinafter more fully described. Subsequent parts of this patent disclosure will also disclose certain other optional features in the hereindescribed invention. For example, the hereindescribed apparatus may be provided with protective layer(s) of padding material in select locations such as around the extended coil spring and over the soccer ball mounting device.

BRIEF DESCRIPTION OF THE DRAWINGS

FIG. 5 is a coil spring of the type used in the elongated soccer ball mounting arm of the herein disclosed soccer ball kicking practice apparatus.

FIG. 6 depicts an elongated soccer ball mounting arm whose inside end is attached to a T-shaped connector and whose outside end is shown partially surrounded by a coil spring.

FIG. 7 depicts an elongated soccer ball mounting arm whose center shaft is in the form of a coil spring and whose outside end is shown partially surrounded by another coil spring.

DETAILED DESCRIPTION OF THE INVENTION

Figure 1:
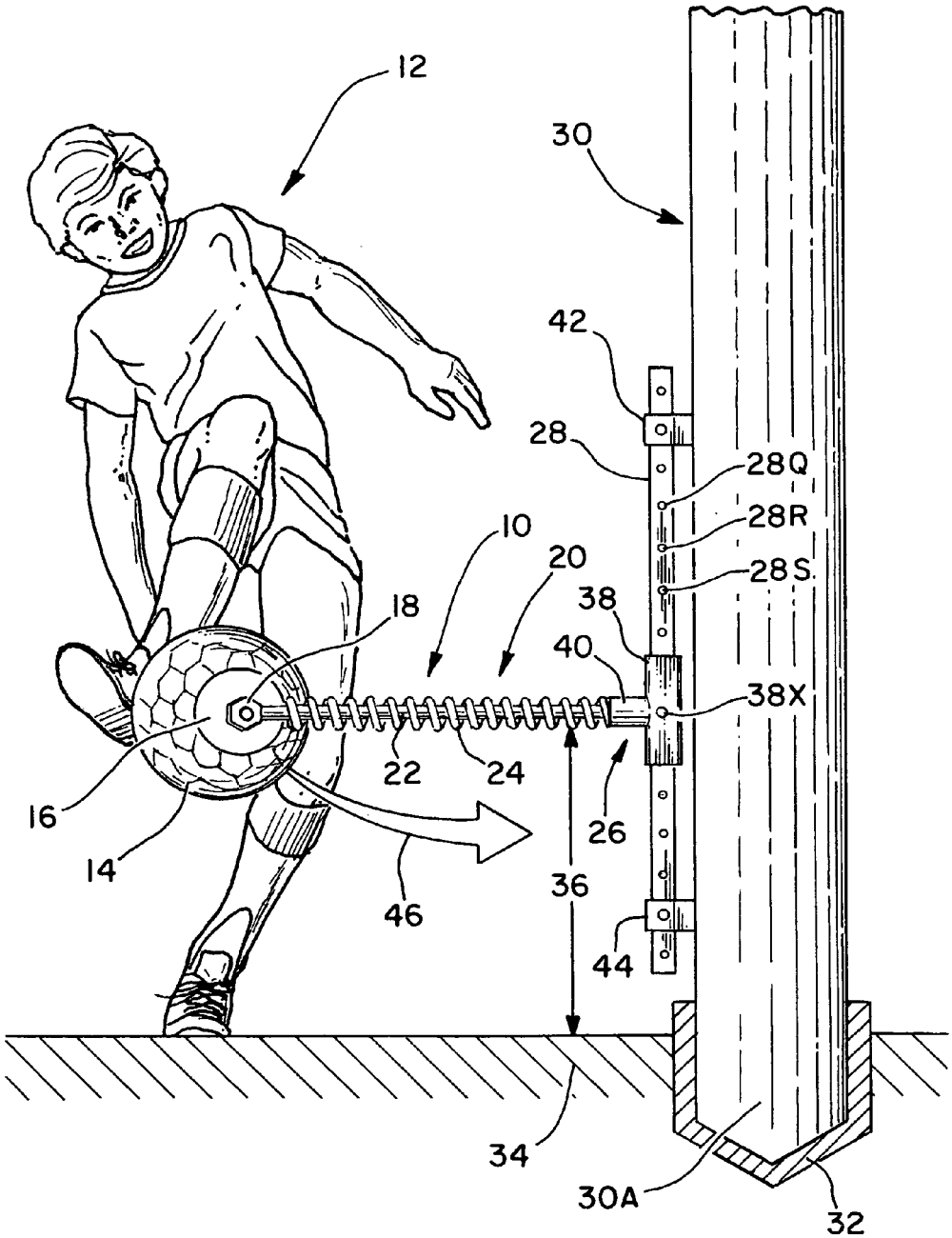
FIG. 1 is a frontal view of an embodiment of the soccer kicking practice apparatus of this patent disclosure being used in the intended manner by a human being.

FIG. 1 depicts the soccer kicking practice apparatus 10 of this patent disclosure being used by a human being 12. A soccer ball 14 is shown attached to a soccer ball holder 16 by a bolt 18. The soccer ball holder 16 is attached to an outer end of an elongated soccer ball mounting arm 20 having a center shaft 22 and a coil spring 24 that substantially surrounds the center shaft 22. An inner end of the elongated soccer ball mounting arm 20 is shown attached to a T-shaped connector 26. The T-shaped connector 26 is shown mounted to a holding post 28. The holding post 28, in turn, is mounted (in a substantially vertical orientation) to a structural element 30. This structural element could for example be an inside wall or an outside wall of a building, a post in the ground, a tree trunk or other suitably strong structure that presents a substantially vertical surface to which this (holding post 28 containing) embodiment of the invention can be mounted. By way of example only, the structural element 30 shown in FIG. 1 is depicted as being a wooden post 30A that is set up in a post holder 32 that is sunk into the ground 34.

FIG. 1 also depicts the elongated soccer ball mounting arm 20 positioned at a desired elevation 36. Some embodiments of this invention provide for varying this mounting arm elevation 36. This variability can, for example, be achieved through use of a T-shaped connector whose T-top element 38 is slidably mounted on a vertically mounted holding post 28. The T-stem element 40 of the T-shaped connector 26 is attached to the elongated soccer ball mounting arm 20 (e.g., attached to the center shaft 22 of said mounting arm 20). The mechanism by which the T-top element 38 can be moved vertically up and down the holding post 28 is more fully detailed in FIG. 12. Basically the T-top element 38 is provided with a hollow shaft (see item 206 in FIG. 12) that encompasses the holding post 28 such that the hollow shaft can slide up or down the holding post substantially between a top mounting bracket and a bottom mounting bracket (such as those depicted as items 42 and 44 in FIG. 1 that serve to affix the holding post 28 to the structural element 30). The holding post 28 of FIG. 1 also is shown provided with an array of holes e.g., holes 28Q, 28R, 28S, etc. that extend through the holding post and through its opposite side. The T-top element 38 is provided with a hole 38X that extends through top element 38 to its opposite side. Thus, a desired elevation 36 of the soccer ball mounting arm 20 can be fixed by aligning the hole 38X in the T-top element 38 with a given hole (e.g., hole 28S) in the vertical post 28 and inserting a bolt, dowel rod, cotter key or other such holding device into the aligned holes and thereby holding the mounting arm 20 (and hence the soccer ball 14 attached to it) at some desired elevation 36. For example, the elevation 36 can be set such that a given human being 12 can practice kicking the soccer ball in a generally horizontal plane such as that suggested by direction arrow 46 in FIG. 1.

Figure 2:
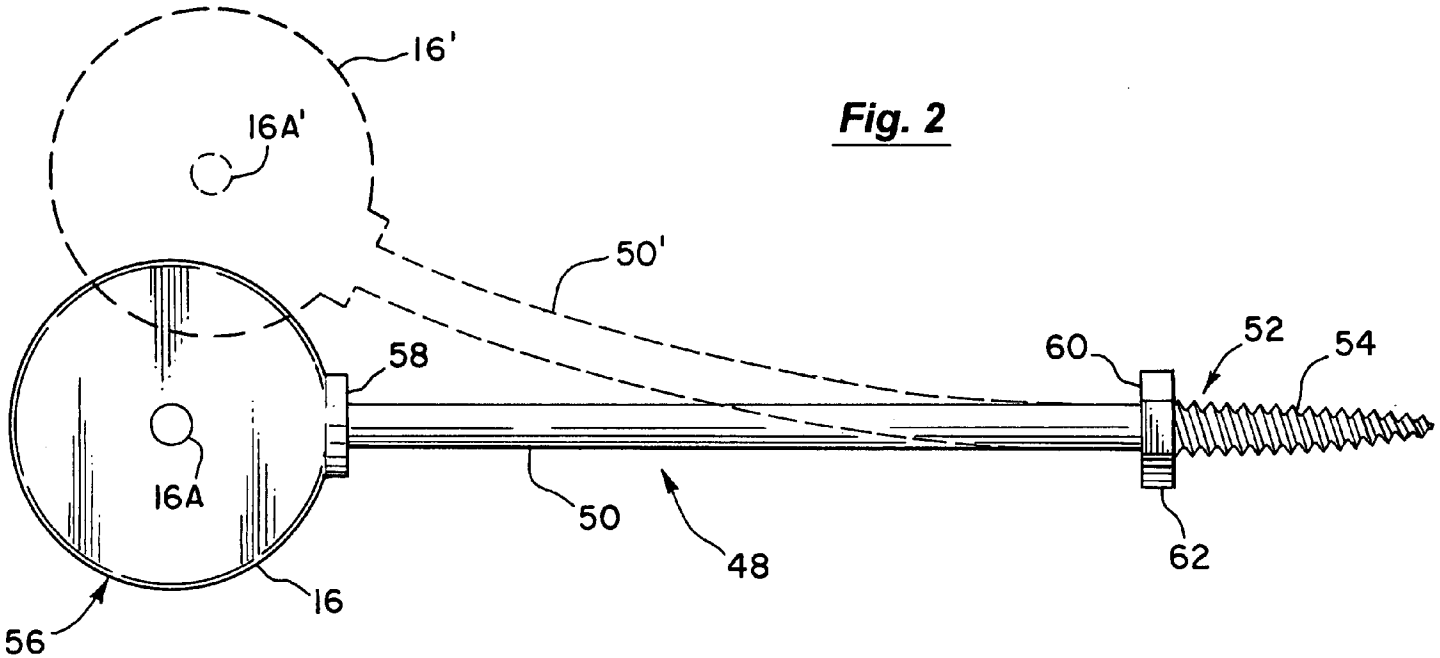
FIG. 2 is a side view of an elongated soccer ball mounting arm of the soccer kicking practice apparatus of this patent disclosure wherein said mounting arm has a center shaft made of an elastic material having a shaft-like or rod-like configuration.

FIG. 2 is a side view of an embodiment of an elongated soccer ball mounting arm 48 of this patent disclosure. It has a center shaft 50 having a generally shaft-like or rod-like configuration. The outside end (left end in FIG. 2) of the center shaft is shown attached to a soccer ball holder 16 having a plate-like configuration. This soccer ball holder 16 is shown provided with a hole 16A for receiving a bolt that is attached to a soccer ball (e.g., in the manner generally depicted in FIG. 13). The inside end (right end) to the center shaft 50 is shown provided with a connector 52. This particular connector 52 has a wood screw configuration 54 such that said connector 52 can be screwed into a suitably receptive structural material such as the wooden post 30A depicted in FIG. 1.

FIG. 2 also depicts (in phantom lines) the center shaft 50, ball holder 16 and bolt hole 16A in their respective alternative positions 50', 16' and 16A'. These alternative positions are intended to illustrate that the center shaft 50 is made of an elastic material that will flex or bend when a force, such as a kicking force 56 is momentarily applied directly (or indirectly) to the center shaft 50 (or, more specifically, to a soccer ball, not shown) attached to the ball holder 16 that, in turn, is attached to the center shaft 50. In order to have this flexible quality the center shaft 50 must be made of an elastic material such as a hard rubber, reinforced hard rubber (such as that employed in automotive tires), or other suitably elastic and durable polymeric material. In actual use according to the teachings of this patent disclosure, a coil spring (not shown in FIG. 2, but otherwise depicted in FIGS. 8 and 9) will be placed between an outside spring end abutting surface 58 and an inside spring end abutting surface 60. Use of a hexagonal-shaped bolt head 61 is a particularly convenient arrangement since the bolt head's top surface 60 can serve as an abutting surface for the right end of a coil spring (not shown) while the hexagonal bolt head 61 can be gripped (e.g., by a wrench (e.g., an open faced wrench)) in order to screw the wood screw portion 54 of the connector 52 into a suitably receptive construction element material such as wood.

Figure 3:
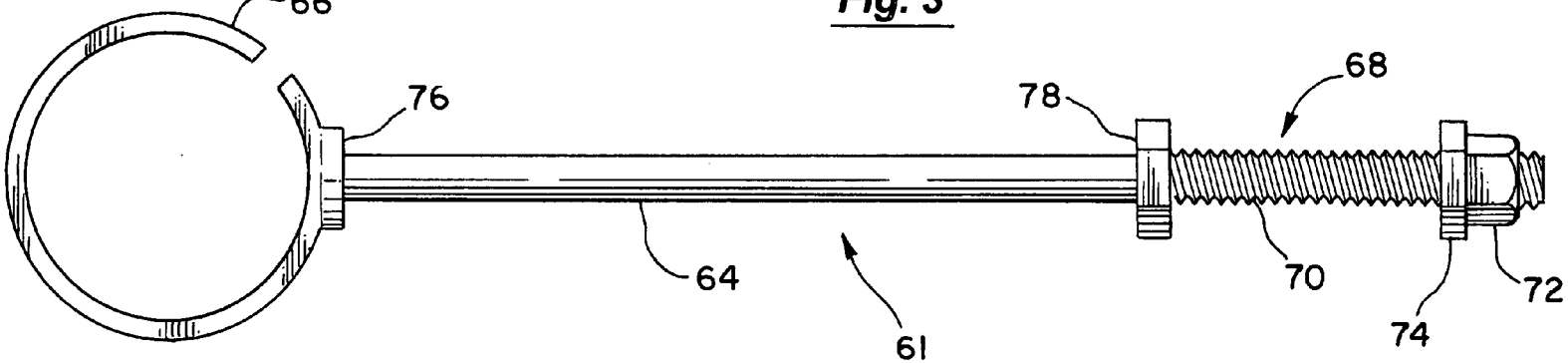
FIG. 3 depicts an elongated soccer ball mounting arm of this patent disclosure having a soccer ball mounting device in the form of an open loop for receiving elastic bands a la the teachings of the '888 patent.

FIG. 3 depicts an elongated soccer ball mounting arm 62 (which may, but need not be made of a flexible material) having a center shaft 64 whose outside (left side in FIG. 3) is provided with a soccer ball mounting device 66 having an open ring configuration. Such an open ring configuration allows a soccer ball to be mounted to the soccer ball holder 66 by elastic bands, e.g., in the manner depicted in the '888 patent. The inside (right side) of this center shaft 64 of mounting arm 62 is shown provided with a connector 68 that is in the form of a machine bolt 70 that is further provided with a nut 72 and washer 74 system. This mounting arm 62 also is shown provided with an outside spring end abutting surface 76 and an inside spring end abutting surface 78 for contacting the respective ends of a spring (not shown) such as those spring ends depicted in FIGS. 5 and 6.

Figure 4:
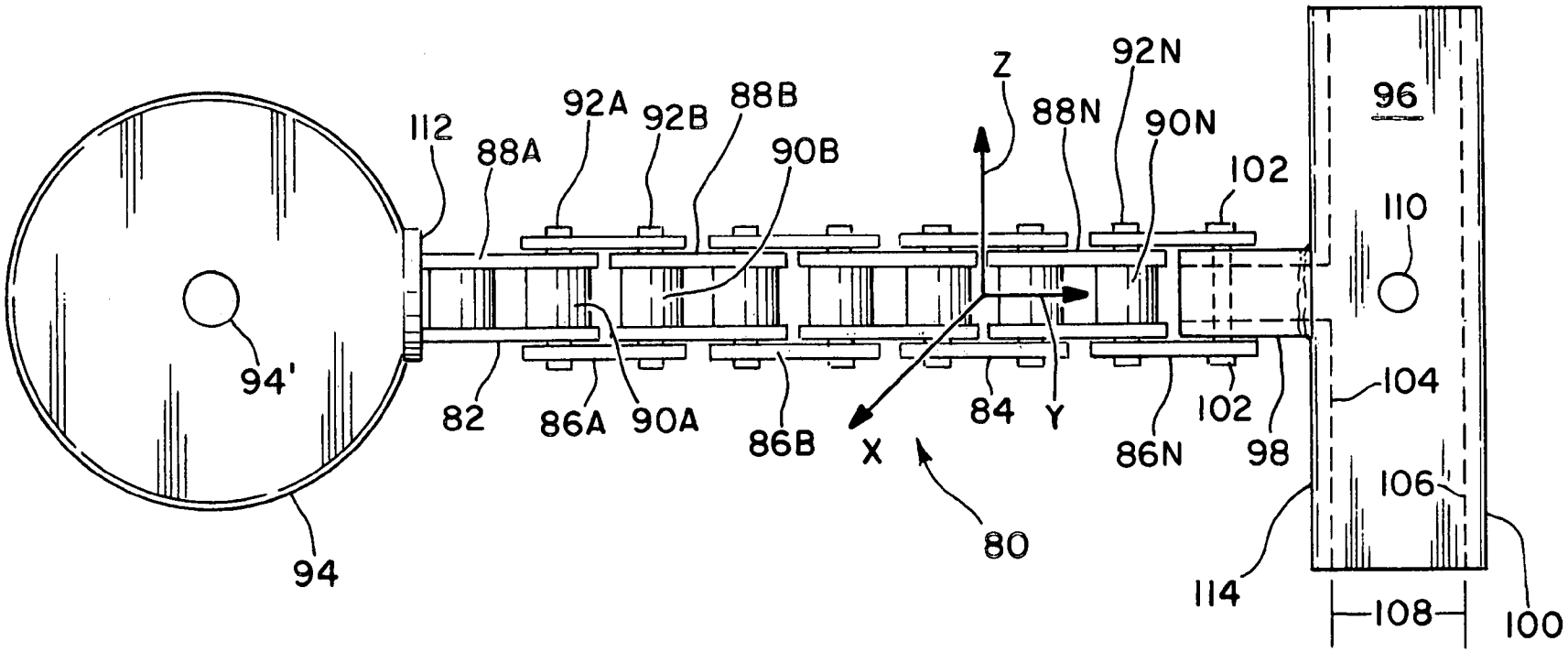
FIG. 4 depicts an elongated soccer ball mounting arm whose center shaft is a roller chain.

FIG. 4 depicts an elongated soccer ball mounting arm 80 whose center shaft 82 is in the form of a roller chain 84. Such roller chains are well known devices. For example, they are commonly used on motorcycles, bicycles, and power driven chain systems for various industrial machines. They are typically used in conjunction with powered sprocket devices whose teeth engage the roller chain. Such roller chains typically have a series of outer link members 86A, 86B . . . 86N; a series of inner link members 88A, 88B . . . 88N; and a series or rollers 90A, 90B . . . 90N held together in a flexible array by a series of bolts or pins 92A, 92B . . . 92N. The outside (left side) of the roller chain 84 is shown attached to a soccer ball holder 94 having a hole 94' for receiving a bolt that is, in turn, attached to a soccer ball in the manner depicted in FIG. 13. The inside (right) end of the elongated soccer ball mounting arm 80 is shown attached to a T-shaped connector 96. This T-shaped connector 96 has a sideward orientation such that the T's stem portion 98 is generally horizontally oriented while the T's top element 100 is generally vertically oriented. The inside end (right end) of the roller chain 84 is shown attached to the end of the horizontally oriented stem portion 98 of the T-shaped connector 96 through use of a mounting pin 102 that passes through both the outer link member 86N and the body of the stem portion 98 of the T-shaped connecter 96.

The inside walls 104 and 106 of the top 100 of the T-shaped connector 96 is shown in phantom lines to illustrate that the top 100 of said connector 96 contains a hole 108. Such a hole 108 can receive the body of a vertically oriented holding post (such as that depicted as item 28 in FIG. 1) and thereby providing a method by which the elongated soccer ball mounting arm 80 can be slidably mounted on such a holding post. The T-shaped connector 96 can be held at some desired elevation (such as that depicted by item 36 in FIG. 1) by passing a holding device (e.g., such as a bolt, pin, cotter key, etc.) through a hole 110 in the top 100 of the T-shaped connector 96 and an analogous hole in the body of the holding post (see for example items 28Q, 28R, 28S in the vertical post 28 shown in FIG. 1).

The outside (left side) of the roller chain 84 is shown providing with a left spring end abutment surface 112. The stem portion 98 of this connector 96 can be provided with a right spring end abutment surface (not shown). In the alternative, the right spring end abutment surface may be provided by the body of the top 100 of the T-shaped connector 96 in a region generally indicated by item number 114. A final point that might be noted with respect to the roller chain 84 shown in FIG. 4 is shown provided with an XYZ Cartesian coordinate system superimposed on its body. It is there to illustrate that the roller chain 84 is highly flexible in the X axis direction, but is not very flexible in either the Y axis or the Z axis. This X axis flexibility is, for example, suggested by item 46 in FIG. 1.

FIG. 5 depicts an elongated coil spring of the type used in the soccer kicking practice apparatus of this patent disclosure. Such a coil spring serves to quickly (with quickly damped vibration) bring an elongated soccer ball mounting (and hence a soccer ball attached to said arm) back to its original position after being kicked. Such a coil spring can, for example, be made of steel or a strong, elastic, and durable polymeric material. Such a coil spring can, for example, have a length 116 of about 6 inches to about 24 inches and an outside diameter 118 from about ½ inch to about 4 inches.

FIG. 6 illustrates an embodiment of this invention wherein a flexible center shaft 120 is shown partially (for purposes of more clearly depicting the presence of the center shaft 120) surrounded by a portion 122 of a coil spring. The inside (right end of the center shaft 120) is shown attached to a stem portion 124 of a T-shaped connector 126 by means of a bolt 128 that passes through both the center shaft 120 and the stem portion 124 of said T-shaped connector 126. FIG. 6 also shows how a washer 130 affixed to this stem portion 124 can be used to provide an abutting surface 132 for the right end (not shown) of a coil spring such as the one partially depicted by item 122. Items 133A and 133B depict a padding material encompassing the spring 122. Such a padding material is preferably made of a foam and/or polymeric material or layered array of foam and/or plastic or cloth materials that have sufficient body to protect the user against accidental injuries.

FIG. 7 illustrates another embodiment of this invention wherein a center shaft 134 is made of a flexible (in the X, Y and Z directions) by virtue of itself being in a coil spring form. This spring 134 is none-the-less surrounded by another coil spring 136 according to the more general teachings of this patent disclosure. For the sake of illustration only, this inner spring/outer spring system is shown attached to a loop type soccer ball seating system such as that shown in FIG. 3.

Figure 8:
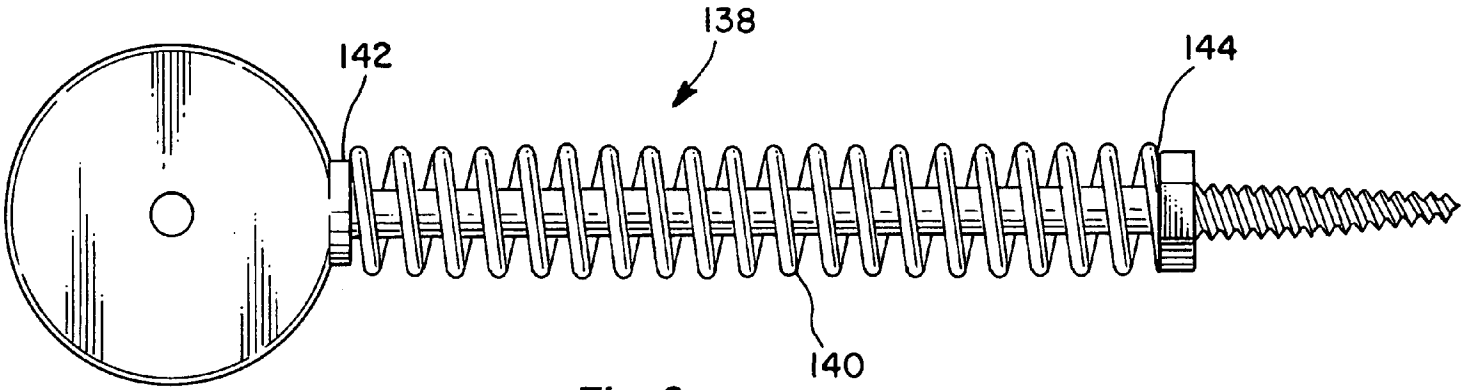
FIG. 8 depicts an elongated coil spring substantially surrounding the center shaft of the elongated soccer ball mounting arm depicted in FIG. 2.

FIG. 8 shows the elongated soccer ball mounting arm 138 of FIG. 2 provided with a coil spring 140 according to the teachings of this patent disclosure. Preferably such a coil spring 140 is in a predetermined state of compression between a left spring end abutting surface 142 and a right spring end abutting surface 144. The state of compression of the coil spring 140 will influence the return of a kicked soccer ball to its original position. This state of compression also influences the kicking force needed to kick the soccer ball in a given manner.

Figure 9:
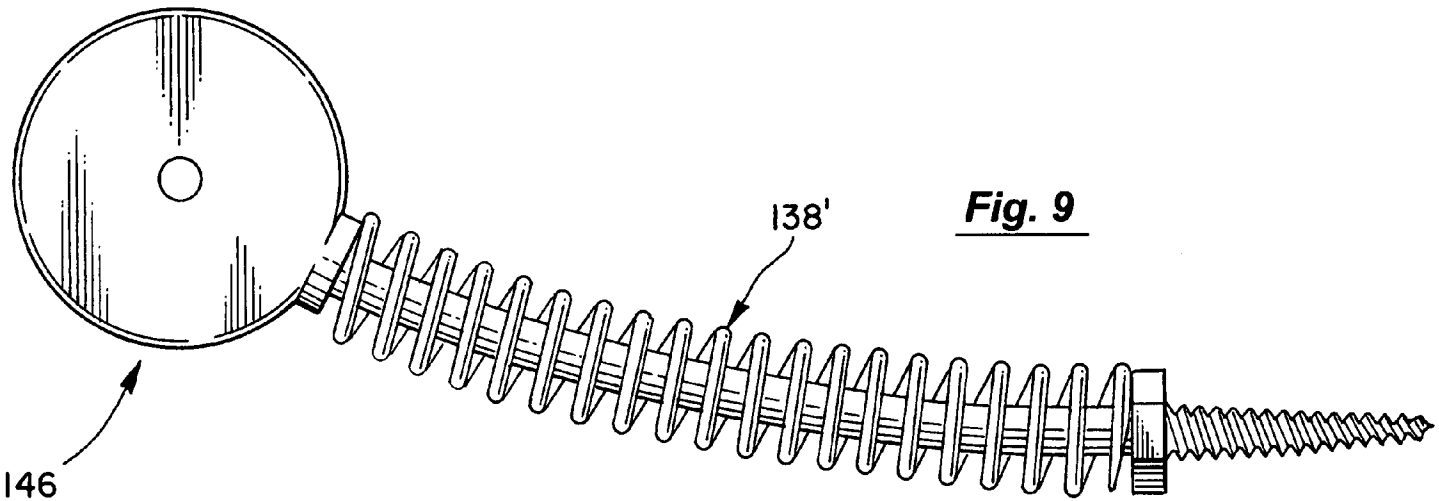
FIG. 9 depicts the elongated soccer ball mounting arm depicted in FIG. 8 being bent under the influence of a force such as that imparted by a kicking action such as that suggested in FIG. 1.

FIG. 9 depicts the elongated soccer ball mounting arm 138 of FIG. 8 depicted in a bent configuration 138' such as would be brought about by a force 146 such as that resulting from kicking a soccer ball (not shown) attached to said elongated soccer ball mounting arm 138.

Figure 10:
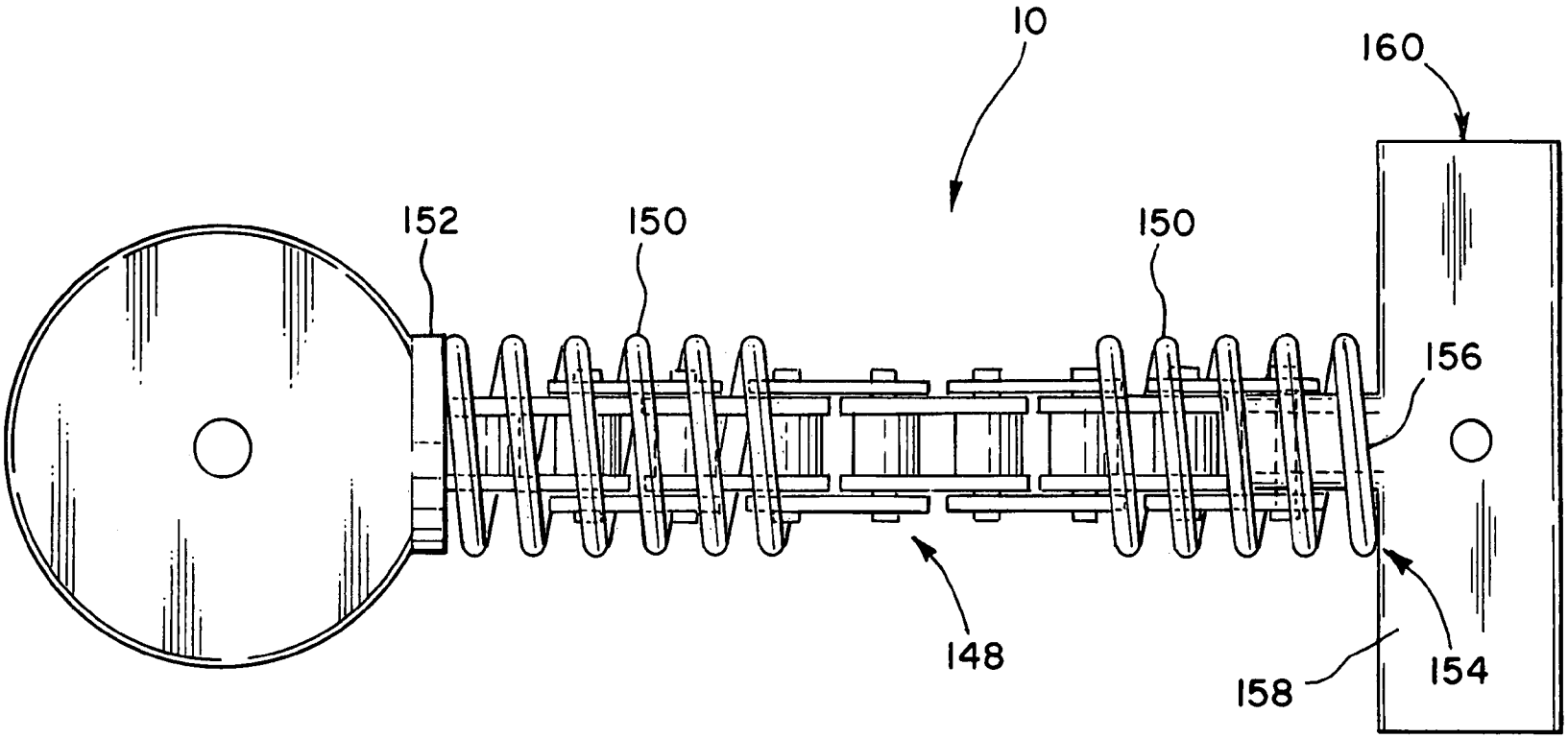
FIG. 10 depicts chain roller portion of the elongated arm depicted in FIG. 4 shown partially surrounded by a coil spring whose center region has been removed in order to better illustrate the presence of the chain roller in this chain roller type elongated soccer ball mounting arm.

FIG. 10 depicts an embodiment of this invention wherein a roller chain type center shaft 148 is shown surrounded with coil spring 150 whose center region is shown removed for purposes of better illustrating the details of the roller chain type center shaft 148. The coil spring 150 is shown residing between a left spring end abutting surface 152 and a right spring end abutting surface 154 which is in fact an under portion 156 of the top portion 158 of a T-shaped connector 160.

Figure 11:
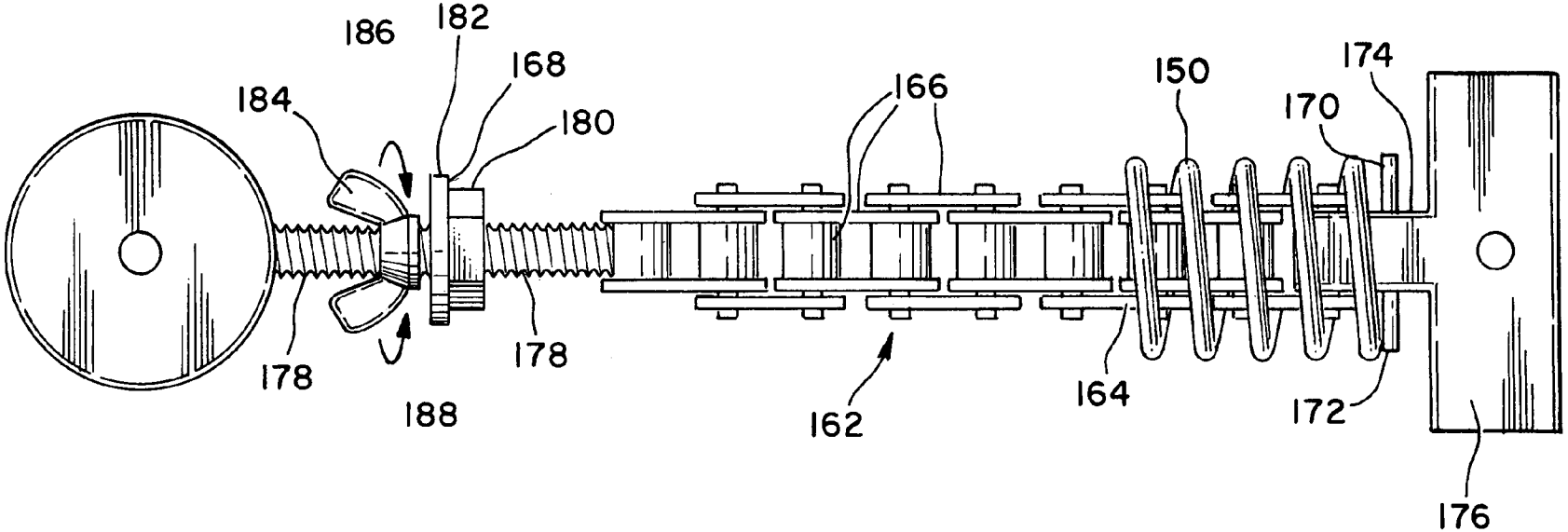
FIG. 11 depicts a chain roller type center shaft that is further provided with a spring compression/decompression device.

FIG. 11 also depicts an elongated soccer ball mounting arm 162 whose center shaft 164 is a roller chain system 166. Such a roller chain system 166 will be surrounded by a coil spring (not shown) such as that depicted in FIG. 5. The coil spring will generally reside between a left side spring abutting surface 168 and a right side spring abutting surface 170 such as that provided by a bolt, pin, rod, etc. 172 that protrudes from a stem portion 174 of a T-shaped connector 176. This elongated soccer ball mounting arm 162 differs from the others heretofore described in that said arm 162 further comprises a threaded shaft 178 to which a threaded bolt 180 is threadedly mounted. The threaded bolt 180 can be (but need not be) attached to a washer 182 that provides the left side spring abutting surface 168 previously discussed.

An alternative mounting arrangement could be provided by placing the washer 182 on the right side of the bolt 180 rather than on the left end of said bolt 180 as depicted in FIG. 11. In either case, the washer 182 may be either free sliding or welded to the bolt 180. Be that bolt/washer arrangement as it may, a wingnut 184 is shown threadedly mounted to the threaded shaft 178. Thus, as the wingnut 184 is threaded toward the elongated soccer ball mounting arm 162, a coil spring (not shown) residing between the left side spring abutting surface 168 and the right side spring abutting surface 170 will be placed in a greater state of compression as the pressure created by turning of the wingnut 184 (e.g., a clockwise turning as suggested by direction arrow 186) further and further compresses the coil spring. Decompression of the spring can be accomplished by turning the wingnut 184 in an opposite direction (e.g., the counterclockwise direction suggested by direction arrow 188) such that the wingnut moves away from the elongated soccer ball mounting arm 162. Again, this compression/decompression of the spring influences the speed at which the kicked ball is returned to its original position as well as the force needed to kick the ball in a given manner.

Figures 12, 12A:
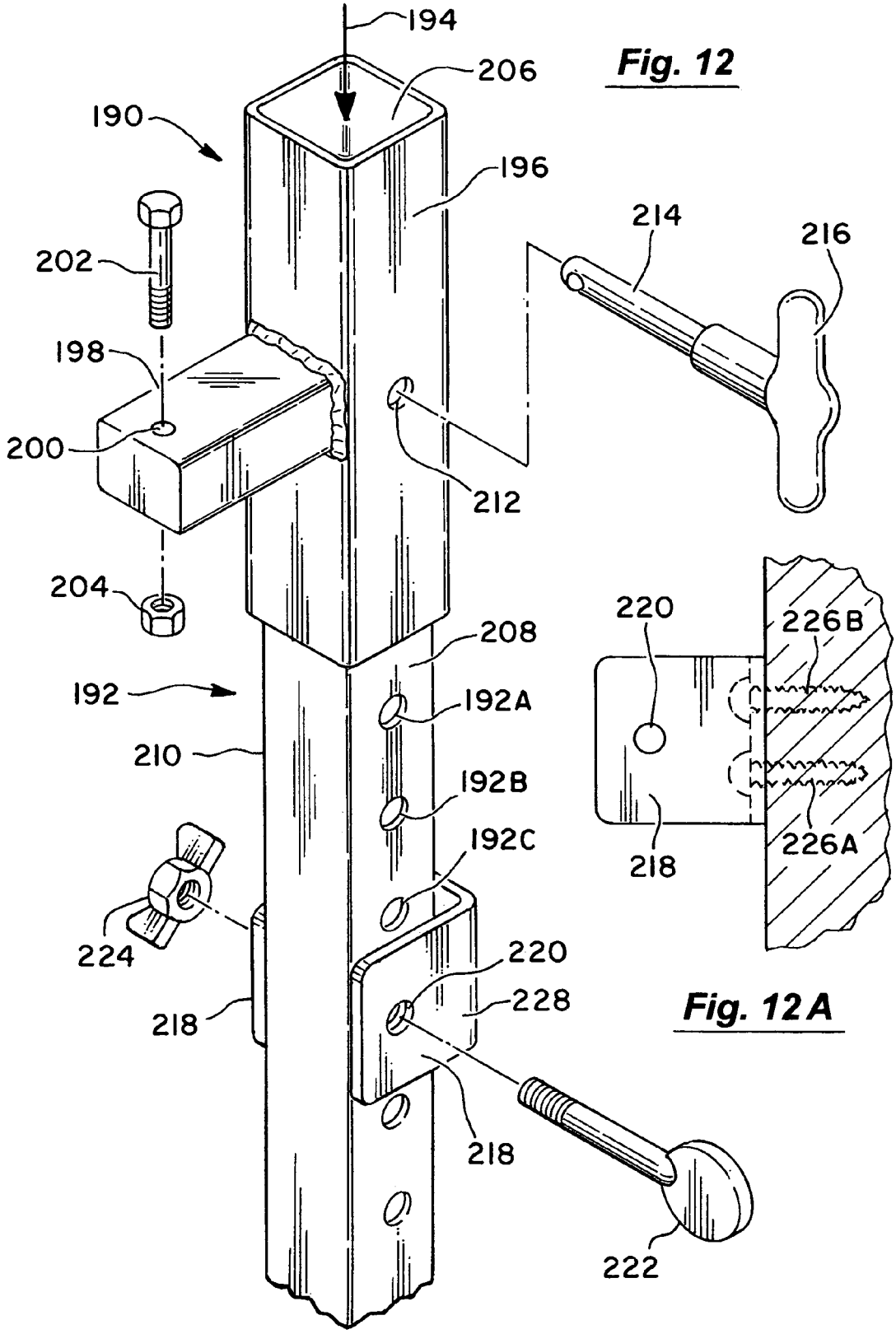
FIG. 12 is a perspective view of a T-shaped connector being slidably mounted to a holding post.

FIG. 12 is a perspective view of a T-shaped connector 190 that is about to be slidably mounted to a holding post 192 in the manner suggested by the direction of arrow 194. The T-shaped connector 190 has a top element 196 and a stem element 198. The stem element 198 is also shown further provided with a hole 200 for receiving a bolt 202 that can be attached to a nut 204 for mounting a center shaft component (not shown) and/or an abutting surface (not shown) for a coil spring (not shown). The top 196 of the T-shaped connector 190 has a hole 206 capable of slidably receiving the body of the holding post 192. The right side 208 of the holding post 192 is shown provided with a series of holes 192A, 192B, 192C, etc. These holes extend through the body of the holding post 192 to and through its left side component 210.

The top 196 of the T-shaped connector 190 is also shown provided with a hole 212 that extends to and through the opposite side of the top 196. The T-shaped connector 190 can be slid up or down the holding post 192 to a desired located wherein the hole 212 in the top 196 of the T-shaped connector 190 is aligned with a desired hole (e.g., hole 192B) in the vertical post 192. A holding rod 214 is then inserted into the aligned holes (212 and 192B). Thus, the T-shaped connector 190, and hence an elongated soccer ball holding arm (not shown) attached to it, is held at a desired elevation such as the elevation 36 depicted in FIG. 1. For convenience, the holding rod 214 can be provided with a handle 216.

The holding post 192 is also shown provided with a holding post attachment device 218 for attaching the holding post 192 to a construction element (a post, a wall, a tree, etc.) having a vertical surface such as the post 30 depicted in FIG. 1. Two such holding post attachment devices (analogous to items 42 and 44 in FIG. 1) will normally be employed. This attachment device 218 is also shown provided with a hole 220 for receiving a holding post attachment bolt 222 that is capable of passing through the holding post attachment device, and the holding post 192 and being provided with a nut 224.

FIG. 12A shows a side view of the holding post attachment device 218 of FIG. 12 wherein said attachment device is further provided with two wood screws 226A and 226B for attaching the holding post attachment device 218 to a suitable construction element such as the post 30 depicted in FIG. 1.

Figure 13:
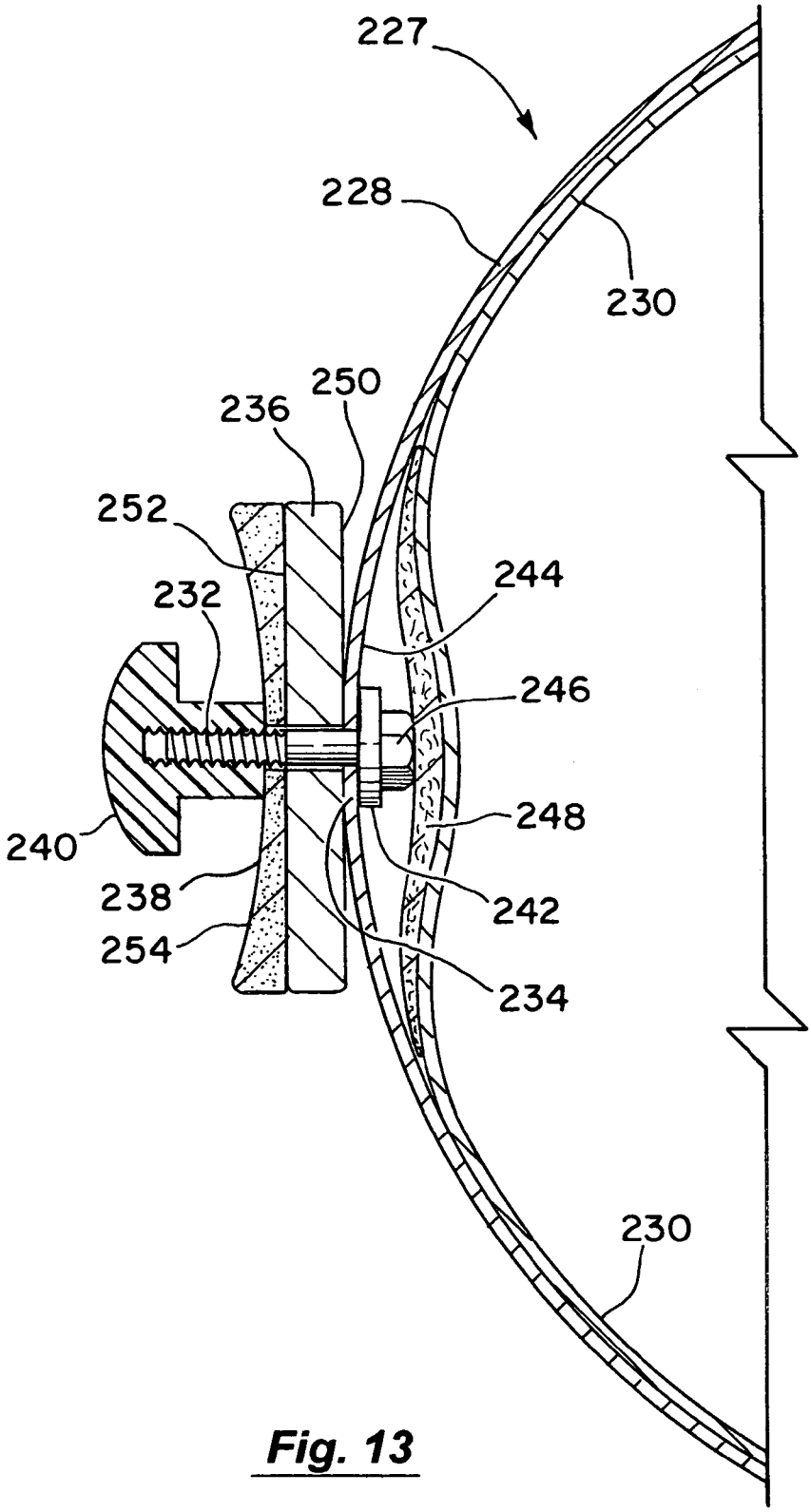
FIG. 13 is a cut-away side view of a soccer ball that is provided with a bolt for mounting said ball to a soccer ball mounting or holding device.

FIG. 13 is a side cut-away view of a soccer ball 227 provided with a mounting bolt that is attached to a soccer ball holder of the type used in the present invention. The soccer ball has an outer cover 228 and an inner air-inflatable bladder 230 common to most commercially available soccer balls. The soccer ball 227 of FIG. 13 is also shown further provided with a bolt 232 that passes through a hole 234 in the soccer ball cover 228. This bolt 232 is also shown passing through a soccer ball abutment/mounting piece 236. Such an abutment/mounting piece 236 may have a concave outer surface 238 to receive and better seat the round outer surface of a soccer ball. The soccer ball cover 228 and soccer ball abutment/mounting piece can be tightly abutted to each other through use of a threaded nut 240 that is mounted to the bolt 232. A washer 242 also can be placed between the inside 244 of the soccer ball cover 228 and the bolt head 246. In the alternative, the bolt head 246 could be on the outside of the abutment mounting piece 236. A bolt head padding piece 248 is placed between the bolt head 246 and the bladder 230. The soccer ball 227 can be abutted against the right side 250 of the soccer ball abutment/mounting piece 236 as shown in FIG. 13. In the alternative such a ball 227 can be mounted on the left side 252 of said abutment/mounting piece 236. The left side 252 of the abutment/mounting piece 236 is shown optionally provided with a padding material 254 having a concave outer surface 238 for seating the round outer surface of a soccer ball.

The above disclosure sets forth a number of embodiments of the present invention described in detail with respect to the accompanying drawings. Those skilled in this art will appreciate that various changes, modifications, other structural arrangements, and other embodiments could be practiced under the teachings of the present invention without departing from the scope of this invention as set forth in the following claims.

What is claimed is:

1. A soccer kicking practice apparatus comprising:

(a) a center shaft made in the form of a roller chain mounted such that the center shaft is horizontally flexible;

(b) a coil spring surrounding a major portion of the center shaft and a coil spring compression/decompression device, said device positioned between a left spring abutting surface and a right spring abutting surface;

(c) a soccer ball mounting device attached to an outside end of a threaded shaft, wherein said threaded shaft further comprises a plate having a hole for receiving a bolt for attachment to a soccer ball;

(d) a connector attached to an inside end of the center shaft, wherein said connector has a T-shaped configuration having a top element; and (e) a holding post capable of slidably receiving the top element of the connector, said holding post having a top mounting bracket and a bottom mounting bracket that serve to affix the holding post to a substantially vertical construction element.

* * * * *